United States Patent [19]

Hefner, Jr.

[11] 4,301,004

[45] Nov. 17, 1981

[54] N-AMINOETHYLPIPERAZINE CONDENSATES FOR BENEFICIATION OF PHOSPHATE ORE

[75] Inventor: Robert E. Hefner, Jr., Midland, Mich.

[73] Assignee: The Dow Chemical Company, Midland, Mich.

[21] Appl. No.: 41,161

[22] Filed: May 21, 1979

[51] Int. Cl.[3] ..... B03D 1/02

[52] U.S. Cl. ..... 209/166

[58] Field of Search ..... 209/166, 167; 544/402

[56] References Cited

U.S. PATENT DOCUMENTS

| | | | |
|---|---|---|---|
| 1,761,546 | 6/1980 | Trotter | 209/166 |
| 2,202,357 | 11/1941 | De Grote | 544/402 X |
| 2,278,060 | 3/1942 | Christmann | 209/166 |
| 2,278,107 | 3/1942 | Jayne | 209/166 |
| 2,312,387 | 3/1943 | Christmann | 209/166 |
| 2,362,276 | 11/1944 | Jayne | 209/166 |
| 2,494,132 | 1/1950 | Jayne | 209/166 |
| 2,508,652 | 5/1950 | Ross | 209/166 X |
| 2,857,331 | 10/1958 | Hollingsworth | 252/61 |
| 3,055,901 | 9/1962 | Speranza | 544/402 X |
| 3,129,166 | 4/1964 | Gillis | 209/166 |
| 3,151,115 | 9/1964 | Moss | 544/402 X |
| 3,452,549 | 2/1969 | Dickson | 209/166 |
| 3,755,447 | 8/1973 | Klemann | 544/402 X |
| 3,793,397 | 2/1974 | Lichtenmater | 544/402 |

FOREIGN PATENT DOCUMENTS

| | | | |
|---|---|---|---|
| 1241821 | 8/1960 | France | 209/166 |

*Primary Examiner*—Robert Halper

[57] ABSTRACT

In the beneficiation of phosphate ore by the flotation of siliceous material, the utilization of a condensate of N-aminoethylpiperazine with a fatty acid or fatty acid ester improves the separation of phosphate from silica. This improvement is especially great in the presence of a co-collector consisting of a polyethylenepolyamine condensed with a fatty acid.

5 Claims, No Drawings

N-AMINOETHYLPIPERAZINE CONDENSATES FOR BENEFICIATION OF PHOSPHATE ORE

BACKGROUND OF THE INVENTION

This invention relates to an improved process for phosphate beneficiation. In particular this invention relates to the use as a collector of N-aminoethylpiperazine condensed with a fatty acid or fatty acid ester in the flotation of siliceous material from phosphate.

In the present commercial beneficiation of siliceous phosphate ores, a deslimed and sized phosphate ore is conditioned with and then floated by a fatty acid collector and fuel oil reagent in an aerated aqueous solution at a pH of at least about 8. This flotation process produces a low-grade phosphate concentrate containing from about 40 to 65 weight percent bone phosphate of lime (BPL). The "rougher float concentrate" from the aforementioned flotation is blunged with acid to remove fatty acid collector coatings and the phosphate is further concentrated by flotation of residual silica from the concentrate with a so-called cationic amine collector.

U.S. Pat. No. 2,278,060 teaches that the reaction product of a polyalkylenepolyamine with a fatty acid, a fatty acid glyceride or other fatty acid esters, as well as their corresponding water-soluble salts, can be used as cationic amine collectors. U.S. Pat. Nos. 2,278,107; 2,312,387; 2,322,201; and 2,710,856 also disclose the use of reaction products of a polyalkylenepolyamine with a fatty acid, alone or in combination with other flotation agents, to effect the flotation of silica from phosphate. U.S. Pat. No. 2,222,728 discloses that certain amine compounds bearing a hydrocarbon chain of six or more carbon atoms are useful as cationic amine collectors.

The prior art cationic amine collectors are effective in beneficiating phosphate ore. However, the demand for the polyethylenepolyamines in alternative, less cost-sensitive uses has resulted in a steady escalation in the price of the prior art cationic amine collectors. The increasing price has spurred a search in the phosphate industry for a flotation agent possessing greater cost-effectiveness. Further, the scarcity of high assay ore deposits has spawned a need for flotation reagents of improved selectivity.

SUMMARY OF THE INVENTION

In accordance with this invention, a process for beneficiating a siliceous phosphate ore by flotation with a collector for the flotation of siliceous matter is improved wherein the collector system comprises an effective amount of a condensate or an acid salt of a condensate of N-aminoethylpiperazine with a fatty acid or fatty acid ester.

DETAILED DESCRIPTION OF THE INVENTION

The N-aminoethylpiperazine utilized as a component of a collector in the practice of this invention can be produced by conventional methods known to the art. One favored method is the preparation of N-aminoethylpiperazine as a co-product in the commercial production of polyethylenepolyamines. The N-aminoethylpiperazine, so prepared, is present in a crude mixture with polyethylenepolyamines. This crude mixture of N-aminoethylpiperazine can conveniently be condensed directly with fatty acid, without further purification, to produce an inexpensive collector.

The fatty acid condensed with the N-aminoethylpiperazine can be a saturated or an unsaturated acid. The fatty acid can suitably bear hydroxyl substituents on its alkyl portion, but such substitution does not impart any substantial advantage. Fatty acids such as oleic, lauric, linoleic, palmitic, stearic, myristic, mixtures thereof and other like fatty acids are operable. The esters corresponding to the fatty acids, such as glycerides, are also operable, but less preferred. For reasons of economy, it is preferred to use crude mixtures of fatty acids, rosin acids, lignin, and unsaponifiable matter derived from vegetable or animal sources, such as tall oil, coconut oil, palm oil, palm kernel oil, cottonseed oil, linseed oil, olive oil, peanut oil, fish oil and the like. Tall oil is an especially preferred mixture of fatty acids and rosin acids.

The fatty acid or a corresponding ester and the N-aminoethylpiperazine can be readily reacted by bringing these reactants together and heating until the desired degree of condensation has taken place. Generally, a reaction temperature of from about 130° C. to 250° C. is operable. The reaction is termed a condensation herein to distinguish it from the formation of the ammonium salt of the acid at lower temperatures. Although it is desirable that the condensation reaction is substantially complete, the condensate is effective as a cationic amine collector even in the presence of a substantial amount of the ammonium salt of the acid. The fatty acid or ester and N-aminoethylpiperazine can operably, but less preferably, be reacted in the presence of alkanolamines (such as triethanolamine) to form a complex mixture of collectors.

The efficacy of the instant collector is greatest when the reactants are condensed in a specific range of mole ratios. The mole ratio of N-aminoethylpiperazine to the total of fatty acid and fatty acid ester should be more than 0.5 mole N-aminoethylpiperazine for each mole of fatty acid or ester, preferably in the range from about 1:1 to about 1:1.5. Advantageously, at least about a stoichiometric amount of the fatty acid and fatty acid ester is reacted with the N-aminoethylpiperazine, but a less than stoichiometric amount is operable if greater loading of the collector is employed to offset dilution by unreacted N-aminoethylpiperazine. In the foregoing mole ratios, the moles of fatty acid in the crude mixtures derived from natural sources include the moles of such minor components as rosin acids and unsaponifiable matter.

The collector system can comprise the cationic amine collector of the present invention utilized by itself or in a mixture of this collector with other cationic amine collectors. In particular, this collector can be used in conjunction with other collectors obtained by the condensation of polyethylenepolyamines condensed with a fatty acid as described in U.S. Pat. No. 2,278,060, to improve the cost effectiveness of the collector system. The term "effective amount" is used herein to denote the amount of the novel condensate required to enhance the activity of the collector system relative to the same system without the novel condensate described. Preferably, the collector comprises at least about 5 weight percent of N-aminoethylpiperazine.

One especially preferred embodiment of this invention is the use of a collector system prepared by the condensation in a single medium of N-aminoethylpiperazine and polyethylenepolyamines with a fatty acid or fatty acid ester. The polyethylenepolyamine is preferably a straight-chain species, but can operably comprise branched and cyclic isomers. Preferably, the N-aminoethylpiperazine and polyethylenepolyamine are present in mole ratios of from about 1:2 to about 2:1, most preferably about 1:1. Desirably, the ratio of moles of fatty acid or ester to the total moles of N-aminoethylpiperazine and polyethylenepolyamine is from about 1:1 to about 4:1, preferably about 2:1 to about 3:1. Preferably, the polyethylenepolyamine is a pentaethylenehexamine, hexaethyleneheptamine, heptaethyleneoctamine, higher polyethylenepolyamine in this series or more preferably a mixture of these higher polyethylenepolyamines with minor amounts (less than 10 weight percent) of lower molecular weight species.

The collection system of this invention can be used alone to beneficiate siliceous phosphate ore after washing, desliming and sizing the ore. However, this collector is more preferably used to beneficiate a so-called "rougher float concentrate", which is obtained by the flotation of the phosphate values in the ore with a fatty acid followed by an acid washing of the collected phosphate to remove the residual fatty acid coating. Desirably, the phosphate is from the so-called Florida phosphate ore, which is substantially free of carbonate impurities after washing and sizing. Generally, a phosphate rougher concentrate in the size range from plus 200 mesh to minus 1 millimeter is amenable to beneficiation by the disclosed process.

The flotation collector, as previously described, can be used in the separation of siliceous matter from phosphate values in a manner like that known in the art for other cationic amine collectors. The flotation feed is deslimed and treated with mineral acid to remove residual fatty acid collector coatings, if necessary. The collector and other flotation reagents are then introduced into an aqueous pulp of the phosphate feed at a density suitable for flotation. The feed can be briefly conditioned with the collector, or, less preferably, aerated without conditioning to float the siliceous matter. The concentrated phosphate rock is then recovered in the underflow.

The optimum loading of the collector system to produce best separation and greatest recovery of the phosphate values is influenced by the relative concentration of phosphate and insolubles (such as sand) in the flotation feed, the use of other collectors, the type of ore bodies, the loading of other flotation adjuvants (for example, fuel oil) and other factors. Generally, if the polyamine condensate is the only collector employed, a ratio of from about 0.05 to about 1 kilogram of condensate per ton of flotation feed is desirable. The use of the disclosed collector at the above-described loadings reduces or obviates the need for frothers, such as pine oil, in the flotation medium.

The collector can be used in conjunction with adjuvants such as activators, conditioning reagents, dispersing reagents, frothing reagents and depressing reagents. It is generally advantageous to employ fuel oil in the medium as an adjuvant to the collector. Representative fuel oils include diesel oil, kerosene, Bunker C fuel oil, mixtures thereof and the like. The fuel oil can operably be employed in any ratio less than about 1 kilogram of fuel oil per ton of flotation feed. Preferably, the fuel oil is present in a ratio of at least about 0.05 kilogram of condensate per ton of flotation feed.

The following examples are illustrative embodiments of this invention. Unless otherwise indicated all parts and percentages are by weight.

EXAMPLES 1–12

Comparative Experiments 1–4

In a series of identical runs that differ only in the loading and identity of the collector employed, a 500 gram charge of phosphate rougher float concentrate washed with mineral acid and water is beneficiated by froth flotation. The rougher float concentrate is derived from phosphate ore mined near Fort Meade, Florida. The above-described concentrate is found by conventional methods of analysis to contain 61.9 percent of BPL. The feed is first diluted with water to obtain a slurry with a pulp density of about 20 percent solids. This slurry is transferred to a Denver flotation machine, where it is combined with a collector.

The collector is prepared by reacting tall oil fatty acid with crude N-aminoethylpiperazine (AEP) at a temperature from about 130° C. to about 225° C. until the reaction is substantially complete (about 2 hours). Substantial completion of the reaction is determined by monitoring the water by-product from the reaction and by infrared analysis of the product. The condensate is then neutralized in a 5 percent aqueous solution with acetic acid to effect a pH of 6. The composition of the tall oil fatty acid (TOFA) is 39 percent rosin acid, 29.3 percent oleic acid, 23 percent linoleic acid, 1.8 percent stearic acid and about 5 percent other fatty acids and components. The crude N-aminoethylpiperazine contains 82 percent N-aminoethylpiperazine, 14 percent diethylenetriamine and 4 percent triethylenetetramine.

In Examples 9–12, an equivalent amount of a polyethylenepolyamine (PEPA) consisting of less than 0.1 percent triethylenetetramine, 8 percent tetraethylenepentamine and a remaining amount of polyethylenepolyamines having at least 10 carbon atoms, is added with the AEP to the TOFA prior to condensation. The mole ratio of the AEP:PEPA:TOFA is either 1:0:1, 1:0:2 or 1:1:2, as is tabulated in Table I for each example.

A PEPA condensate with TOFA, not embodied in the claimed process, is also employed in some comparative experiments to provide a basis for comparison of the efficacy of the mixed condensate. The mole ratio of the PEPA:TOFA in these comparative experiments is 1:1.

All of the above-described collectors are introduced into the flotation slurry in 0.2, 0.175, 0.15 and 0.125 charges. An amount of fuel oil #2 equal in weight to the charge of collector is also introduced to the slurry. The phosphate rougher float concentrate is then briefly conditioned with the collector and fuel oil by high speed agitation of the flotation medium. Flotation is promoted by aeration with mixing at a reduced speed for two or three minutes, during which the floating concentrate is collected.

The concentrate collected and the tail material are individually dewatered by 150 mesh screen and dried. Both the concentrate and tail fractions are analyzed for percent BPL by standard photometric methods against a water/reagent reference.

In Table I is tabulated the mole ratio of the components condensed, the loading of the collector in kilograms per metric ton of phosphate feed and the BPL assay of the tail and concentrate. The weight distribution of phosphate in each of these fractions is also normalized and tabulated as a percentage of the total phosphate to provide indices of the degree of separation effected.

TABLE I

| Example | Condensate Ratio (AEP:PEPA:TOFA) | Loading (kg/ton) | Concentrate (% BPL) | Tail (% BPL) | Normalized Distribution % Concentrate | % Tail |
|---|---|---|---|---|---|---|
| 1 | 1:0:2 | 0.125 | 17.3 | 67.1 | 3.23 | 96.77 |
| 2 | " | 0.15 | 14.1 | 68.3 | 2.96 | 97.04 |
| 3 | " | 0.175 | 18.9 | 68.7 | 4.43 | 95.57 |
| 4 | " | 0.2 | 18.1 | 68.7 | 4.58 | 95.42 |
| 5 | 1:0:1 | 0.125 | 3.0 | 70.0 | 0.61 | 99.39 |
| 6 | " | 0.15 | 4.1 | 72.1 | 1.02 | 98.98 |
| 7 | " | 0.175 | 6.1 | 72.5 | 1.65 | 98.35 |
| 8 | " | 0.2 | 5.4 | 72.5 | 1.45 | 98.55 |
| 9 | 1:1:2 | 0.125 | 8.7 | 72.4 | 2.25 | 97.75 |
| 10 | " | 0.15 | 5.9 | 73.4 | 1.74 | 98.26 |
| 11 | " | 0.175 | 14.2 | 74.2 | 4.75 | 95.25 |
| 12 | " | 0.2 | 17.5 | 74.1 | 6.28 | 93.72 |
| Comparative Experiment* | | | | | | |
| 1 | 0:1:1 | 0.125 | 5.5 | 71.9 | 1.30 | 98.70 |
| 2 | " | 0.15 | 10.9 | 73.3 | 3.15 | 96.85 |
| 3 | " | 0.175 | 16.0 | 73.4 | 5.49 | 94.51 |
| 4 | " | 0.2 | 21.0 | 73.4 | 8.35 | 91.65 |

*Not an embodiment of this invention.

The data in Table I demonstrates the efficacy of the AEP/TOFA condensates as collectors for phosphates. Particularly noteworthy is the fact that the mixed condensate of AEP and PEPA with TOFA (Examples 9–12) exhibit greater selectivity and recovery in flotation than either of the component condensates.

EXAMPLES 13–16

In a manner otherwise similar to Examples 9–12, the phosphate rougher float concentrate is floated with a collector prepared by condensing AEP and PEPA with a tall oil fatty acid "heads" (HTOFA). The HTOFA contains a fatty acid portion consisting of 54 percent palmitic acid, 20.3 percent oleic acid, 12.6 percent linoleic acid, 1 percent rosin acid and about 12 percent of other fatty acids. The HTOFA also comprises an unsaponifiable fraction of about 30 percent by weight. This collector contains the above-identified components condensed in a mole ratio of 1 part AEP, 1 part PEPA and 2 parts HTOFA (including the unsaponifiable fraction, which is assigned an estimated average molecular weight). The pertinent data from these flotations is tabulated in Table II.

The data in Table II shows that the described collector is a very powerful one, which should be employed at relatively low loadings.

EXAMPLES 17–19

In a manner otherwise similar to Examples 5–8, a phosphate rougher float concentrate derived from phosphate ore from the Fort Green Mine in Florida is floated with reduced loadings of a 1:1 (mole ratio) condensate of AEP and TOFA. The data collected from these flotations is tabulated in Table II.

TABLE II

| Example | Loading (kg/ton) | Concentrate (% BPL) | Tail (% BPL) | Normal Distribution % Concentrate | % Tail |
|---|---|---|---|---|---|
| 13 | 0.125 | 13.3 | 75.3 | 4.22 | 95.78 |
| 14 | 0.15 | 21.0 | 74.7 | 8.09 | 91.91 |
| 15 | 0.175 | 21.0 | 74.6 | 8.82 | 91.18 |
| 16 | 0.2 | 34.7 | 74.6 | 18.26 | 81.74 |
| 17 | 0.05 | 3.0 | 58.0 | 0.10 | 99.90 |
| 18 | 0.10 | 2.5 | 66.6 | 0.63 | 99.37 |
| 19 | 0.15 | 3.5 | 71.8 | 0.84 | 99.16 |

EXAMPLES 20–25

In a manner otherwise similar to Examples 13–16, a phosphate rougher float concentrate derived from phosphate ore from the Fort Green Mine in Florida is floated with reduced loadings of a condensate prepared with AEP, PEPA and HTOFA present in the mole ratios of 1:1:2 or 1:1:3. The data collected in these flotations is tabulated in Table III.

TABLE III

| Example | Condensate Ratio (AEP:PEPA:HTOFA) | Loading (kg/ton) | Concentrate (% BPL) | Tail (% BPL) | Normalized Distribution % Concentrate | % Tail |
|---|---|---|---|---|---|---|
| 20 | 1:1:2 | 0.05 | 0.79 | 64.66 | 0.09 | 99.91 |
| 21 | " | 0.10 | 1.35 | 71.76 | 0.41 | 99.59 |
| 22 | " | 0.15 | 3.83 | 73.45 | 1.32 | 98.68 |
| 23 | 1:1:3 | 0.05 | 0.90 | 64.32 | 0.14 | 99.86 |
| 24 | " | 0.10 | 1.92 | 73.00 | 0.62 | 99.38 |
| 25 | " | 0.15 | 5.06 | 74.35 | 1.80 | 98.20 |

EXAMPLES 26–30

In a manner otherwise similar to Examples 13–16, a phosphate rougher float concentrate derived from phosphate ore from the Fort Green Mine in Florida is floated in a Wenco Flotation Machine with 0.15 kilograms per ton of a condensate prepared from AEP, PEPA and HTOFA present in mole ratios from 1:1:3 to 1:1:7. The data collected in these flotations is tabulated in Table IV.

TABLE IV

| Example | Condensate Ratio (AEP:PEPA:HTOFA) | Concentrate (% BPL) | Tail (% BPL) | Normalized Distribution % Concentrate | % Tail |
|---|---|---|---|---|---|
| 26 | 1:1:3 | 5.77 | 69.45 | 1.12 | 98.88 |
| 27 | 1:1:4 | 6.70 | 74.12 | 1.53 | 98.47 |
| 28 | 1:1:5 | 14.33 | 74.76 | 4.26 | 95.74 |
| 29 | 1:1:6 | 11.89 | 74.31 | 3.20 | 96.80 |
| 30 | 1:1:7 | 14.39 | 73.36 | 3.82 | 96.18 |

What is claimed is:

1. In a process for beneficiating a siliceous phosphate ore by froth flotation with a collector system for the flotation of siliceous matter, the improvement wherein the collector system comprises an effective amount of a condensate or an acid salt of a condensate of a tall oil fatty acid or tall oil fatty acid ester with (1) a polyethylenepolyamine corresponding to the formula $H_2N—C_2H_4NH—_xC_2H_4—NH_2$, wherein x is an integer of from 4 to 11 and (2) a N-aminoethylpiperazine, said collector system comprising at least about 5 weight percent N-aminoethylpiperazine.

2. The process as described in claim 1 wherein the collector system is prepared by simultaneously condensing the polyethylenepolyamine and the N-aminoethylpiperazine with the fatty acid or fatty acid ester in a single reaction medium.

3. The process as described in claim 1 wherein the ratio of equivalents of fatty acid or fatty acid ester to the total equivalents of aminoethylpiperazine and polyethylenepolyamine is from about 1:1 to about 4:1.

4. The process as described in claim 3 wherein fuel oil is present in the collector system.

5. The process as described in claim 4 wherein the N-aminoethylpiperazine and the polyethylenepolyamine are present in the collector system in a mole ratio in the range from about 1:2 to about 2:1 and the fatty acid is a tall oil fatty acid.

* * * * *

UNITED STATES PATENT AND TRADEMARK OFFICE

CERTIFICATE OF CORRECTION

PATENT NO. : 4,301,004

DATED : November 17, 1981

INVENTOR(S) : Robert E. Hefner, Jr.

It is certified that error appears in the above—identified patent and that said Letters Patent is hereby corrected as shown below:

Cover page, References Cited, at the first patent listed the date of the patent "6/1980" should be -- 6/1930 -- ;

Column 6, Table II, "Normal Distribution" should read -- Normalized Distribution -- ;

Column 7, line 19, the portion of the formula "$-C_2H_4NH-_x$" should read -- $\{C_2H_4NH\}_x$ -- .

Signed and Sealed this

Twentieth Day of July 1982

[SEAL]

Attest:

GERALD J. MOSSINGHOFF

Attesting Officer

Commissioner of Patents and Trademarks